US005938203A

United States Patent [19]

Beckwith, Sr.

[11] Patent Number: 5,938,203

[45] Date of Patent: Aug. 17, 1999

[54] PORTABLE TARGET STAND AND TARGET

[76] Inventor: James C. Beckwith, Sr., 5402 E. Gamble Quail Pl., Sierra Vista, Ariz. 85635

[21] Appl. No.: 08/990,235

[22] Filed: Dec. 15, 1997

[51] Int. Cl.[6] ..... F41J 1/10

[52] U.S. Cl. ..... 273/407

[58] Field of Search ..... 273/407, 408, 273/403, 404, 400, 402

[56] References Cited

U.S. PATENT DOCUMENTS

| | | | |
|---|---|---|---|
| D. 335,311 | 5/1993 | Robinson | D21/5 |
| 4,029,318 | 6/1977 | Boss | 273/407 |
| 4,189,146 | 2/1980 | Warner | 273/408 |
| 4,295,648 | 10/1981 | Stromback | 273/402 X |
| 4,726,593 | 2/1988 | Wade | 273/407 X |
| 4,813,684 | 3/1989 | Bruno | 273/403 |
| 5,209,492 | 5/1993 | Hamilton | 273/407 |
| 5,240,258 | 8/1993 | Bateman | 273/392 |
| 5,346,227 | 9/1994 | Amram et al. | 273/400 |

*Primary Examiner*—William H. Grieb

[57] ABSTRACT

A portable target stand and target including base portion. The base portion has a pair of bottom supports and a pair of T-supports. The pair of bottom supports each having an elbow joint fixedly attached. Each of the elbow joints of each of the pair of bottom supports, will allow releasable coupling of the pair of bottom supports and the pair of T-supports. One of the pair of T-supports has a first center projection. Another of the pair of T-supports has second center projection. An upper support bar has a first upper elbow joint and a second upper elbow joint. A pair of side arms are included and each side arm has an upper free end and a lower free end. Each of the pair of side arms has a receiving slot. The upper free end of each of one of the pair of side arms is releasable coupled with the first upper elbow joint of the upper support bar. The upper free end of another of the pair of side arms is releasable coupled with the second upper elbow joint of the upper support bar. The lower free end of the first side arm is releasably positioned within the first center projection of the one of the T-supports. The lower free end of the second side arm being releasably positioned within the second center projection of another of the T-supports. Lastly, a target member is provided.

1 Claim, 2 Drawing Sheets

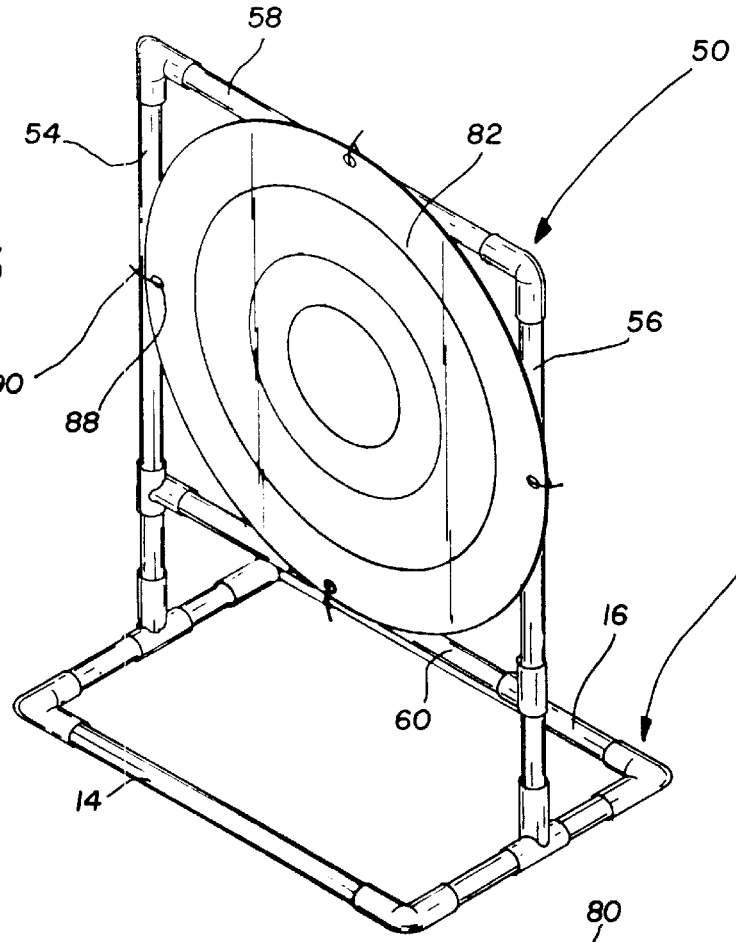
FIG.3
FIG.4
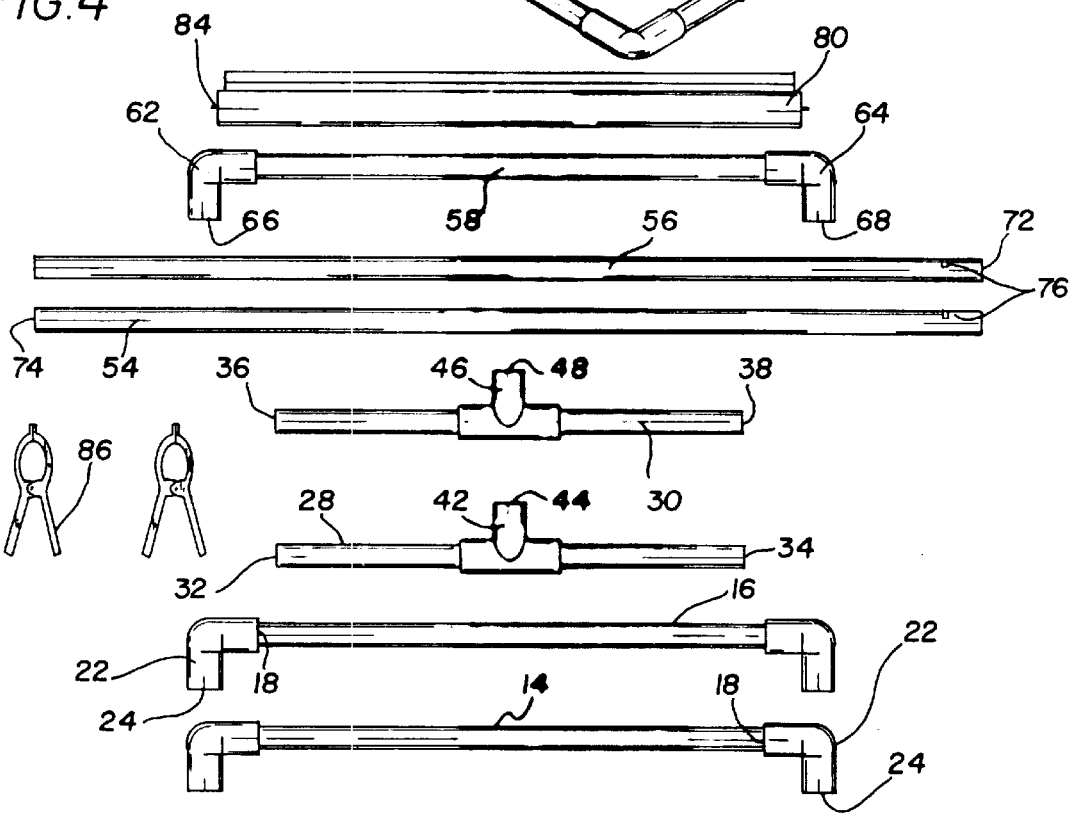

PORTABLE TARGET STAND AND TARGET

BACKGROUND OF THE INVENTION

1. Field of the Invention

The present invention relates to a portable target stand and target and more particularly pertains to providing a portable target stand for holding targets of various types.

2. Description of the Prior Art

The use of a portable target is known in the prior art. More specifically, portable targets heretofore devised and utilized for the purpose of target practice are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,209,492 to Hamilton discloses a shooting target stand. U.S. Pat. No. 5,240,258 to Bateman discloses a versatile pop-up/knock-down target system. U.S. Pat. No. 4,813,684 to Bruno discloses a target for a bow and arrow. U.S. Pat. No. 4,029,318 to Boss discloses a portable and adjustable target stand. U.S. Pat. No. 4,726,593 to Wade discloses a portable target assembly. Lastly, U.S. Pat. No. Des. 335,311 to Robinson discloses a target support.

In this respect, the portable target stand and target according to the present invention substantially departs from the conventional concepts and designs of the prior art, and in so doing provides an apparatus primarily developed for the purpose of providing a portable target stand for holding targets of various types.

Therefore, it can be appreciated that there exists a continuing need for a new and improved portable target stand and target which can be used for providing a portable target stand for holding targets of various types. In this regard, the present invention substantially fulfills this need.

SUMMARY OF THE INVENTION

In view of the foregoing disadvantages inherent in the known types of portable targets now present in the prior art, the present invention provides an improved portable target stand and target. As such, the general purpose of the present invention, which will be described subsequently in greater detail, is to provide a new and improved portable target stand and target which has all the advantages of the prior art and none of the disadvantages.

To attain this, the present invention essentially comprises a generally rectangular base portion. The base portion has a pair of elongated bottom supports and a pair of T-supports. The pair of elongated bottom supports form a first bottom support and a second bottom support. The first bottom support and the second bottom support each have an pair of ends with each end having an elbow joint fixedly attached. Each elbow joint of each end of each of the pair of bottom supports has a free end. The T-supports each forming a first T-support and a second T-support. The first T-support has a first end and a second end. The second T-support has a first end and a second end. The first end of the first T-support is releasably coupled with the free end of one of the elbow joints of the first bottom support. The second end of the first T-support is releasably coupled with the free end of one of the elbow joints of the second bottom support. The first end of the second T-support is releasably coupled with the free end of another of the elbow joints of the first bottom support. The second end of the second T-support is releasably coupled with the free end of another of the elbow joints of the second bottom support. The first and second elongated bottom supports are in a parallel orientation when coupled with the first and second T-supports.

Also, the first T-support has a first center projection that defines an first opening. The second T-support has a second center projection that defines a second opening. The first center projection extends upwardly from the first T-support. The second center projection extends upwardly from the second T-support. Additionally, an upper support bar is provided. The upper support bar has a first upper elbow joint and a second upper elbow joint. The first upper elbow joint has a first free end and the second upper elbow joint has a second free end.

A pair of elongated side arms form a first side arm and a second side arm. The first side arm has an upper free end and a lower free end. The second side arm has an upper free end and a lower free end. Each of the pair of elongated side arms has a receiving slot therein. The receiving slot is spaced from the upper free end of each of the side arms. The upper free end of the first side arm is sized for releasable coupling with the first upper elbow joint of the upper support bar. The upper free end of the second side arm is sized for releasable coupling with the second upper elbow joint of the upper support bar.

The lower free end of the first side arm is releasably positioned within the first opening of the first center projection of the first T-support. The lower free end of the second side arm is releasably positioned within the second opening of the second center projection of the second T-support. The first side arm and the second side arm each support the upper support bar in a plane above the base portion, when they are positioned within the first and second center projection. Lastly, a retractable target member is included. The retractable target member has a pair of end pins. One of each end pin is positioned within one of the receiving slots of the pair of elongated side arms for supporting the retractable target member above the base portion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable target stand and target which has all the advantages of the prior art portable targets and none of the disadvantages.

It is another object of the present invention to provide a new and improved Portable target stand and target which may be easily and efficiently manufactured and marketed.

It is a further object of the present invention to provide a new and improved portable target stand and target which is of a durable and reliable construction.

An even further object of the present invention is to provide a new and improved Portable target stand and target which is susceptible of a low cost of manufacture with regard to both materials and labor, and which accordingly is then susceptible of low prices of sale to the consuming public, thereby making such Portable target stand and target economically available to the buying public.

Still yet another object of the present invention is to provide a new and improved Portable target stand and target which provides in the apparatuses and methods of the prior art some of the advantages thereof, while simultaneously overcoming some of the disadvantages normally associated therewith.

Still another object of the present invention is to providing a portable target stand for holding targets of various types.

Lastly, it is an object of the present invention to provide a new and improved base portion. The base portion has a pair of bottom supports and a pair of T-supports. The pair of bottom supports each having an elbow joint fixedly attached. Each of the elbow joints of each of the pair of bottom supports, will allow releasable coupling of the pair of bottom supports and the pair of T-supports. One of the pair of T-supports has a first center projection. Another of the pair of T-supports has second center projection. An upper support bar has a first upper elbow joint and a second upper elbow joint. A pair of side arms are included and each side arm has an upper free end and a lower free end. Each of the pair of side arms has a receiving slot. The upper free end of each of one of the pair of side arms is releasable coupled with the first upper elbow joint of the upper support bar. The upper free end of another of the pair of side arms is releasable coupled with the second upper elbow joint of the upper support bar. The lower free end of the first side arm is releasably positioned within the first center projection of the one of the T-supports. The lower free end of the second side arm being releasably positioned within the second center projection of another of the T-supports. Lastly, a target member is provided.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric view of the portable target stand and a bull's eye target of the present invention.

FIG. 4 is a top plan view of the disassembled target stand of the present invention.

Similar reference characters refer to similar parts throughout the several views of the drawings.

DESCRIPTION OF THE PREFERRED EMBODIMENT

Figure 1:
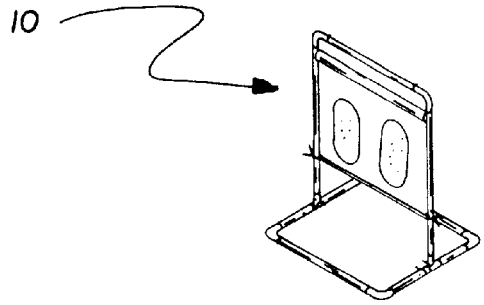
FIG. 1 is a perspective illustration of the preferred embodiment of the portable target stand and target constructed in accordance with the principles of the present invention.

With reference now to the drawings, and in particular to FIG. 1 thereof, a new and improved portable target stand and target embodying the principles and concepts of the present invention and generally designated by the reference numeral 10 will be described.

The present invention, the new and improved Portable target stand and target, is comprised of a plurality of components. Such components in their broadest context include a base portion, a framed upright portion and a target. Such components are individually configured and correlated with respect to each other so as to attain the desired objective.

Figure 2:
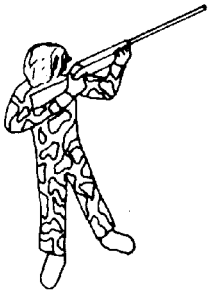
FIG. 2 is an isometric view of the portable target stand and a retractable target of the present invention.
Figure 2:
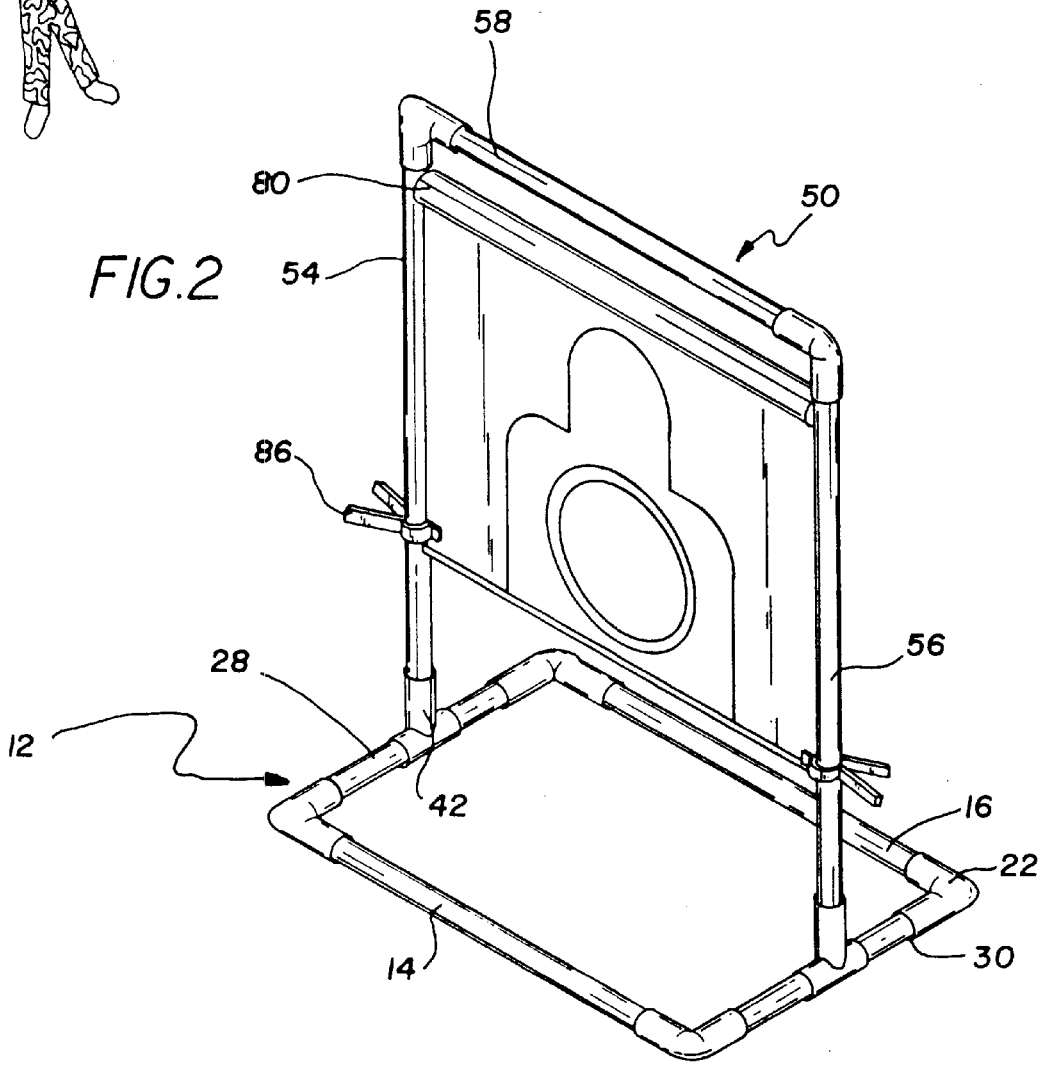

More specifically, the present invention includes a generally rectangular base portion 12, as seen in FIG. 2. The base portion has a pair of elongated bottom supports and a pair of T-supports. The pair of elongated bottom supports form a first bottom support 14 and a second bottom support 16. FIG. 4 shows the first bottom support and the second bottom support each have an pair of ends 18 with each end having an elbow joint 22 fixedly attached. Each elbow joint of each end of each of the pair of bottom supports has a free end 24.

The pair of T-supports forming a first T-support 28 and a second T-support 30. The first T-support has a first end 32 and a second end 34. The second T-support has a first end 36 and a second end 38. The first end of the first T-support is releasably coupled with the free end of one of the elbow joints of the first bottom support 14. The second end of the first T-support is releasably coupled with the free end of one of the elbow joints of the second bottom support 16. The first end of the,second T-support is releasably coupled with the free end of another of the elbow joints of the first bottom support 14. The second end of the second T-support is releasably coupled with the free end of another of the elbow joints of the second bottom support 16. The first and second elongated bottom supports are in a parallel orientation, as shown in FIG. 3, when coupled with the first and second T-supports.

Also, the first T-support has a first center projection 42 that defines an first opening 44. The second T-support has a second center projection 46 that defines a second opening 48. The first center projection extends upwardly from the first T-support. The second center projection extends upwardly from the second T-support.

Also, a framed upright portion 50 is provided. As illustrated in FIG. 2, the framed upright portion is formed by a pair of elongated side arms 54 and 56, and an upper support bar 58. Is may be structured with or without a cross bar 60. As illustrated in FIG. 4, the upper support bar has a first upper elbow joint 62 and a second upper elbow joint 64. The first upper elbow joint has a first free end 66 and the second upper elbow joint has a second free end 68.

The pair of elongated side arms form a first side arm 54 and a second side arm 56. Each side arm has an upper free end 72 and a lower free end 74. Each of the pair of elongated side arms has a receiving slot 76. The receiving slot is spaced from the upper free end of each of the side arms, as shown in FIG. 4. The upper free end of the first side arm is sized for releasable coupling with the first upper elbow joint of the upper support bar. The upper free end of the second side arm is sized for releasable coupling with the second upper elbow joint of the upper support bar.

Additionally, the lower free end of the first side arm is releasably positioned within the first opening 44 of the first center projection of the first T-support. The lower free end of the second side arm is releasably positioned within the second opening 48 of the second center projection of the second T-support. The first side arm and the second side arm each support the upper support bar in a plane above the base portion, when they are positioned within the first and second center projection.

Lastly, a target member is provided. The target member may be a retractable target member 80 or a bull's eye 82. FIGS. 1 and 2 show the retractable target member. FIG. 3 shows the bull's eye target member. The retractable target member functions like a window blind. The retractable target member has a pair of end pins 84. One of each end pin is positioned within one of the receiving slots of the pair of elongated side arms for supporting the retractable target member above the base portion. The retracted target in an extended position, a pair of clips 86 are use to hold it in place.

Furthermore, the bull's eye target member has a plurality of openings 88 that are proportionately spaced therearound, as seen in FIG. 3. A plurality of ties 90 are provided, with one each looping through one of the openings for coupling the target member to the pair of side arms, the upper support and the cross bar.

The present invention portable target stand and target is a portable, adjustable stand for holding targets. The stand is structured to hold a retractable target and a bull's eye target. The stand has a base portion and a framed upright portion. The base portion is formed by connecting a pair of T-supports to a pair of bottom support with a plurality of elbow joints. The stand is made out of plastic tubing. The base portion is wide and the four corners are connected with plastic elbow joints. The framed upright portion has a width that is equal to the width of the base portion. Included with the portable stand is a nylon carrying case.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable target stand and target for target practice comprising in combination:

a generally rectangular base portion having a pair of elongated bottom supports and a pair of T-supports, the pair of elongated bottom supports forming a first bottom support and a second bottom support, the first bottom support and the second bottom support each having a pair of ends with each end having an elbow joint fixedly attached thereto, each elbow joint of each end of each of the pair of bottom supports having a free end, the T-supports forming a first T-support and a second T-support, the first T-support having a first end and a second end, the second T-support having a first end and a second end;

the first end of the first T-support being releasably coupled with the free end of one of the elbow joints of the first bottom support, the second end of the first T-support being releasably coupled with the free end of one of the elbow joints of the second bottom support, the first end of the second T-support being releasably coupled with the free end of another of the elbow joints of the first bottom support, the second end of the second T-support being releasably coupled with the free end of another of the elbow joints of the second bottom support, the first and second elongated bottom supports being in a parallel orientation when coupled with the first and second T-supports;

the first T-support having a first center projection defining an first opening, the second T-support having a second center projection defining a second opening, the first center projection extending upwardly from first T-support, the second center projection extending upwardly from the second T-support;

an upper support bar having a first upper elbow joint and a second upper elbow joint, the first upper elbow joint having a first free end and the second upper elbow joint having a second free end;

a pair of elongated side arms forming a first side arm and a second side arm, the first side arm having an upper free end and a lower free end, the second side arm having an upper free end and a lower free end, each of the pair of elongated side arms having a receiving slot therein with the receiving slot spaced from the upper free end of each, the upper free end of the first side arm being sized for releasable coupling with the first upper elbow joint of the upper support bar, the upper free end of the second side arm being sized for releasable coupling with the second upper elbow joint of the upper support bar;

the lower free end of the first side arm being releasably positioned within the first opening of the first center projection of the first T-support, the lower free end of the second side arm being releasably positioned within the second opening of the second center projection of the second T-support, the first side arm and the second side arm support the upper support bar in a plane above the base portion when positioned within the first and second center projection; and a retractable target member having a pair of end pins, one of each end pin being positioned within one of the receiving slots of the pair of elongated side arms for supporting the retractable target member above the base portion;

a pair of spring clips coupled with the pair of elongated side arms, each of the pair of clips engaging a lower end of the retractable target member in an extended orientation.

* * * * *